US005839341A

United States Patent [19]

Johnson et al.

[11] Patent Number: 5,839,341

[45] Date of Patent: Nov. 24, 1998

[54] PUNCH UNIT

[75] Inventors: Gary E. Johnson, Ramsey; Richard J. Schweiger, Andover, both of Minn.

[73] Assignee: Mate Precision Tooling, Ramsey, Minn.

[21] Appl. No.: 635,256

[22] Filed: Apr. 12, 1996

[51] Int. Cl.[6] ..... B26F 1/14

[52] U.S. Cl. ..... 83/530; 83/140; 83/686; 83/698.91

[58] Field of Search ..... 83/136, 139, 140, 83/686, 698.91, 699.31, 699.41, 530

[56] References Cited

U.S. PATENT DOCUMENTS

| | | | |
|---|---|---|---|
| 1,834,918 | 12/1931 | Altvater | 83/699.31 X |
| 2,172,272 | 9/1939 | Booth . | |
| 3,079,824 | 3/1963 | Schott . | |
| 3,335,627 | 8/1967 | Smelts . | |
| 3,600,999 | 8/1971 | Daniels | 83/698.91 X |
| 3,848,496 | 11/1974 | Stevens et al. . | |
| 3,871,254 | 3/1975 | Whistler, Jr. et al. . | |
| 3,926,082 | 12/1975 | von Langendorff . | |
| 3,935,771 | 2/1976 | Cady, Jr. . | |
| 3,935,772 | 2/1976 | Demus et al. . | |
| 3,958,476 | 5/1976 | Bartha . | |
| 4,012,975 | 3/1977 | LaLone . | |
| 4,031,787 | 6/1977 | Cady . | |
| 4,141,264 | 2/1979 | Weisbeck . | |
| 4,166,403 | 9/1979 | DiDonate, Jr. et al. . | |
| 4,375,774 | 3/1983 | Wilson et al. . | |
| 4,377,957 | 3/1983 | Wheeler . | |
| 4,440,052 | 4/1984 | Weisbeck . | |
| 4,457,196 | 7/1984 | Cady . | |
| 4,691,602 | 9/1987 | Schlueter . | |
| 4,989,484 | 2/1991 | Johnson et al. . | |
| 5,020,407 | 6/1991 | Brinlee . | |
| 5,054,347 | 10/1991 | Johnson et al. . | |
| 5,056,392 | 10/1991 | Johnson et al. . | |
| 5,072,620 | 12/1991 | Hill et al. | 83/530 X |
| 5,081,891 | 1/1992 | Johnson et al. . | |
| 5,131,303 | 7/1992 | Wilson et al. . | |
| 5,301,580 | 4/1994 | Rosene et al. . | |
| 5,329,835 | 7/1994 | Timp et al. . | |
| 5,419,225 | 5/1995 | Fujita . | |

FOREIGN PATENT DOCUMENTS

| | | |
|---|---|---|
| 0 000 762 | 2/1979 | European Pat. Off. . |
| 0 532 147 | 3/1993 | European Pat. Off. . |
| 0 646 427 | 4/1995 | European Pat. Off. . |
| 1414343 | 9/1965 | France . |
| 40-6551 | 1/1994 | Japan . |
| 615382 | 1/1994 | Japan . |
| 6226373 | 8/1994 | Japan . |
| 2 050 910 | 1/1981 | United Kingdom . |
| 94/07663 | 4/1994 | WIPO . |

*Primary Examiner*—Eugenia A. Jones
*Attorney, Agent, or Firm*—Larson & Taylor

[57] ABSTRACT

A punch unit allows an adjustable length adjustment of the punch by disengaging projection-seat means which connect the housing and the guide bushing and then rotating the guide bushing relative to the housing. Additionally, the housing has mutually engaging housing top and bottom parts that have engaging fingers and corresponding grooves that cooperate during punching. The connection between the housing and guide bushing includes a C-ring, attached to the housing, having protrusions which are biased to engage a groove located on the guide bushing.

26 Claims, 6 Drawing Sheets

FIG. 3
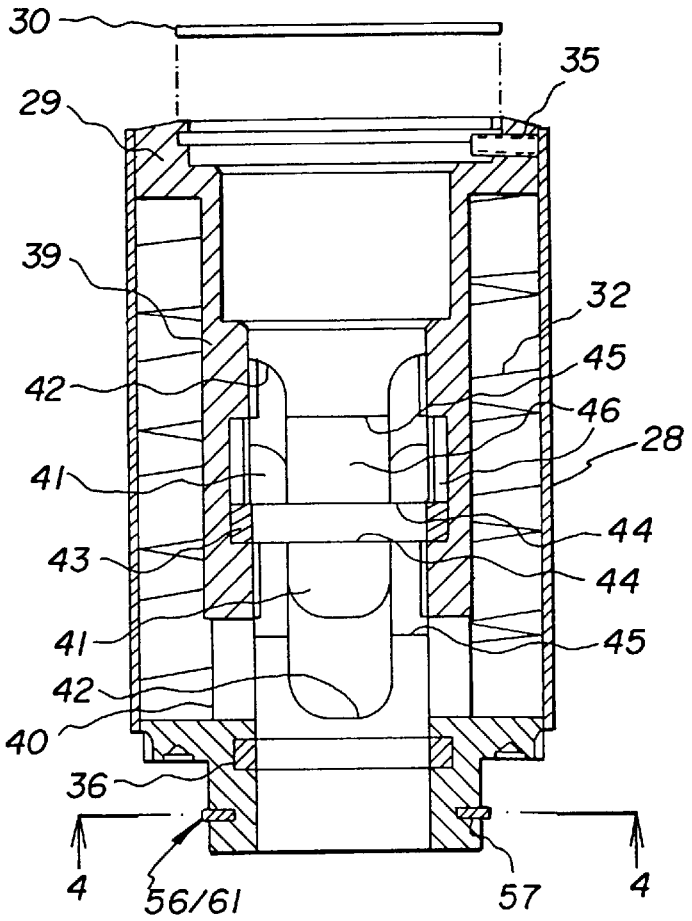
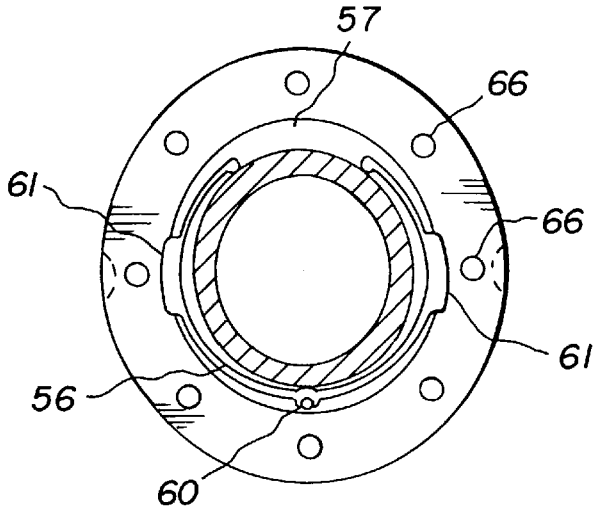
FIG. 4

PUNCH UNIT

FIELD OF THE INVENTION

The invention relates to a punch unit, and, more particularly, to a punch unit which provides an improved structural engagement between the main parts of the punch, which structure facilitates punch length adjustment. The invention also relates to a punch unit housing which includes an improved structural engagement and movement concurrent with the punch stroke and spring compression.

BACKGROUND OF THE INVENTION

In general, a punch unit includes a punch driver connected with a punch. The punch driver has a punch head at its back end and a structure which prevent relative rotation between the punch and the punch driver during the stroke of the punch. An axially displaceable pre-loaded compression return spring is located between the punch head and a guide bushing receiving the punch to return the punch driver and punch to their rest position following the punch stroke.

Punch units of this general type are shown in a number of prior patents, including U.S. Pat. Nos. 4,092,888; 4,375,774; 5,131,303; 5,329,835; and PCT Patent Nos. WO 96/03261; WO 96/05030.

However, while these prior punch units are satisfactory in various respects, a need still exists to provide an improved punch unit having an improved structural arrangement for simply and efficiently facilitating punch length adjustment. A need also exists for an improved structural engagement and movement of the housing concurrent with the punch stroke and spring compression.

SUMMARY OF THE INVENTION

It is therefore a primary object of the invention to provide a punch unit which provides an improved structural engagement between the main parts of the punch, which structure facilitates punch length adjustment. Another primary object of the invention is to provide a punch unit that provides an improved structural engagement and movement of the housing concurrent with the punch stroke and spring compression.

One primary object of the invention is achieved by providing a punch unit, wherein the length of the punch is adjusted by effecting relative rotation between a housing part of the punch unit and a guide bushing part thereof through disengagement of resilient engagement between facing surfaces of the housing and guide bushing.

In accordance with a preferred embodiment of the invention, the punch unit includes a housing, a punch driver which has front and back ends and is axially received in the housing and a guide bushing. A punch is mounted in the guide bushing against rotational movement relative to the guide bushing. The punch is either attached to the front end of the punch driver or integral therewith and spring means guides the punch driver axially away from the guide bushing. Indexing means rotationally position the guide bushing relative to the housing such that, (1) during normal operation of the punch unit, the punch driver, the housing and the guide bushing remain fixed against rotation relative to each other and (2) for adjustment purposes, rotating the guide bushing and housing relative to each other acts through the punch driver and punch to adjust the length of the punch.

In a preferred embodiment, engagement between the housing and the guide bushing includes snap-in projection and seat means, preferably in the form of spring biased balls or the like in one of these members which engage detents in the other. During normal operation the projection-seat engagement is strong enough to prevent these parts from rotating relative to each other. However, this engagement is selectively broken, when necessary, to allow one of these parts to be turned relative to the other to effect adjustment of the punch length. In the more common applications, the ball-detent engagement, while strong enough to prevent indexing during normal operation, is weak enough to allow relative turning of these parts by simply manually grasping one part and turning it relative to the other. In other applications where strong turning forces are applied to one main part or the other during normal operation, it may be necessary to replace at least one of the balls with a projection which engages its detent more positively than a ball and which must therefore be positively moved out of its detent before these parts can be turned relative to each other.

In accordance with another preferred feature of the invention, the housing comprises a pair of opposed top and bottom housing parts having engaging fingers and grooves, the fingers being secured together by a ring element. During the punch stroke and spring compression, the top and bottom parts move towards each other, with the fingers on each part moving within grooves in the other part.

In accordance with another preferred feature of the invention, a structure is provided for simple engagement of the guide bushing to the remainder of the punch unit which comprises radial protrusions, located on a C-ring which surrounds the remainder of the punch unit, which sit within an interior circumferential groove located within the guide bushing.

It is, therefore, an object of the invention to provide a punch having an improved structural engagement between the main parts of the punch, which structure facilitates punch length adjustment by rotational indexing of the guide bushing relative to the housing in selected discrete amounts which are selected when the balls or other snap-in projections are moved out of their respective seats.

It is yet another object of the invention to provide simple disengagement of the guide bushing from the remainder of the punch unit by pushing buttons which effect separation of radial protrusions biased by the C-ring within an interior circumferential groove located within the guide bushing.

It is yet another object of the invention to provide new and improved structure for engagement and movement of the housing upon the punch stroke and spring compression.

The invention will be explained in detail below by means of exemplary embodiments illustrated in the drawings.

BRIEF DESCRIPTION OF THE DRAWINGS

There follows a detailed description of preferred embodiments of the present invention which are to be taken together with the accompanying drawings, wherein:

FIG. 3 is a central cross-sectional view of the upper portion of the punch unit, with the punch driver removed;

FIG. 4 is a cross-sectional view along line 4—4 of FIG. 3;

DETAILED DESCRIPTION OF THE PREFERRED EMBODIMENTS

Referring now to the figures, like elements are represented by like numerals throughout the several views.

Figure 1:
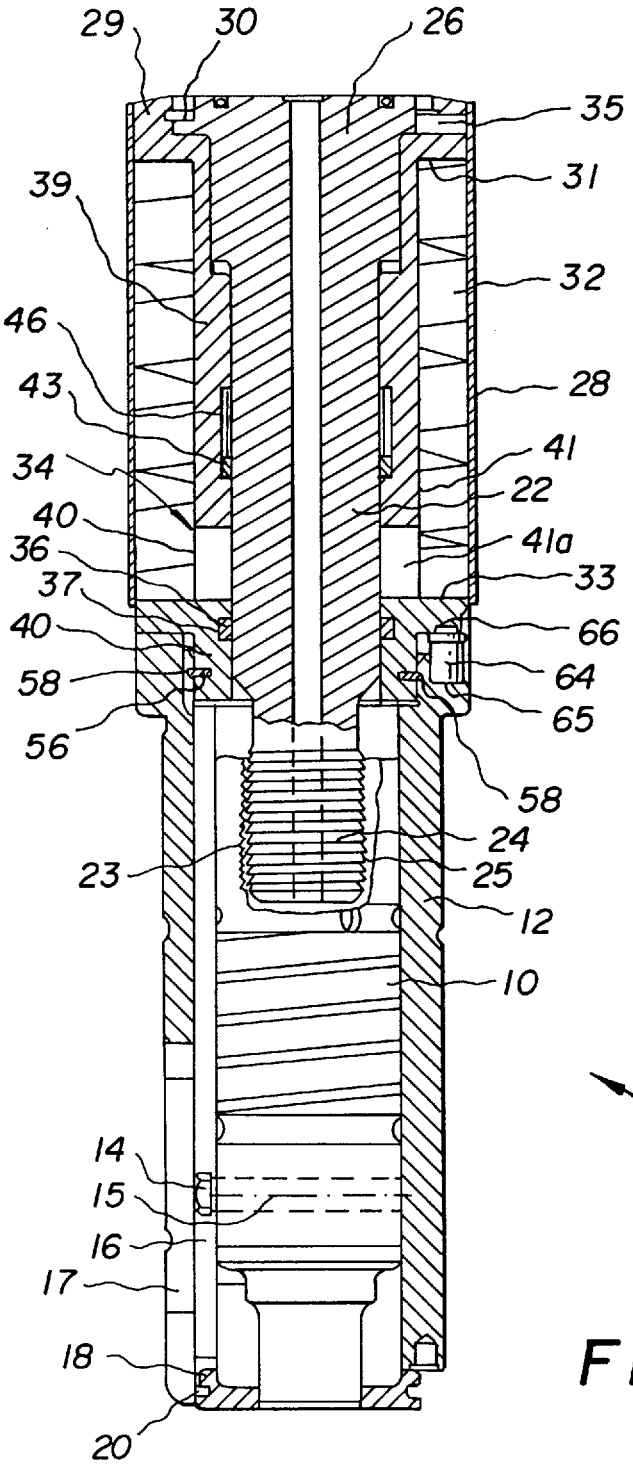
FIG. 1 is a central cross-sectional view of a first embodiment of the punch unit of the invention in the completely assembled state.

The punch unit 1 shown in FIG. 1 includes a punch 10 guided linearly displaceably in a guide bushing 12. Rotation of the punch 10 relative to the guide bushing 12 is prevented by rotation preventing means such as a pin 14 which is fixedly seated in a radial bore 15 in the punch 10. Pin 14 protrudes radially, and engages an interior longitudinal groove 16 in the guide bushing 12. Axial groove 17 is open radially outwardly so that a second pin on a machine frame (not shown) or other securing member can engage the groove 17 from the outside and can maintain the guide bushing 12 non-rotatingly on the machine frame (not shown). Stripper plate 18 is fastened on the lower end of the guide bushing 12 by being biased against safety washer 20.

The back or upper end of punch 10 is connected to a punch driver 22. To compensate for the loss of length which results from regrinding the punch 10, the punch 10 and the punch driver 22 are connected by a threaded connection which permits adjustment of the length of the combined punch 10 and punch driver 22 by rotating the threadedly engaged punch and punch driver relative to each other. In the embodiment shown in FIG. 1, the back end of the punch 10 is provided with a threaded bore 23, which threadedly engages the front end 24 of the punch driver 22, which is provided with an exterior thread 25. The total length of the punch 10 and the punch driver 22 is set by rotating the front end 24 of the punch driver 22 and the threaded bore 23 of the punch 10 relative to each other by varying amounts. A punch head 26 seated at the back of the punch driver 22 receives the force generated by a punching machine (not shown) to actuate the punch unit 1.

In the embodiment of FIGS. 1–5, the punch unit 1 is extended rearwardly by a housing 34 which includes a set collar 29 at the rear end thereof, wherein the housing 34 is surrounded by compression spring 32 which acts between a front stop surface 33 and a rear stop surface 31. A slip-on bushing 28 surrounds the housing and spring. The slip-on bushing 28 includes an interior thread at the rear end, into which set collar 29 is screwed as a ring insert. Set collar 29 axially receives punch head 26, and punch head 26 is prevented from being removed by C-ring 30. A forward facing shoulder of set collar 29 constitutes a back stop surface 31, or a back spring seat, for compression spring 32. A front stop surface 33 or front spring seat is formed by a rear facing shoulder of housing 34.

In the assembled state as shown in FIG. 1, the securing pin 35 or other type of radial protrusion engages the circumference of the exterior circumferential surface of the punch head 26. In this way, the punch driver 22 is held fixed against relative rotation with respect to the housing 34, the bushings 28 and 12 and, therefore, also with respect to the punch 10. The combined punch 10 and punch driver 22 are able to be guided through the interior of housing 34 to effectuate punching. An annular ring 36 is disposed within a groove 37 located on the interior of housing 34 near front stop surface 33. Annular ring 36 can be made of rubber and makes slight frictional contact with punch driver 22 to keep punch driver 22 from easily falling out the back end of the punch unit 1 when C-ring 30 is removed. However, the slight frictional contact is not enough to prevent manual removal of punch driver 22 from punch unit 1.

During a punch stroke, guide bushing 12 guides pin 14 of punch 10 along the interior longitudinal groove 16 during punching. Guide bushing 12 is affixed to housing 34, of punch driver 22, by connecting means (discussed in greater detail below) so as to be rotatable with respect to housing 34.

The punch unit 1 in accordance with the invention also preferably utilizes indexing elements to control relative rotation of the punch 10 and punch driver 12. The indexing elements may be constituted by a connection between facing radial surfaces on the housing 34 and the guide bushing 12 which is interlocking in the circumferential direction.

Referring to FIGS. 1–4, the indexing means comprises multiple snap-in projection means such as detent mechanisms 64 around the top edge of the circumference of guide bushing 12 fitted into detent bores 65 which are located in guide bushing 12. The detent mechanisms 64 and detent bores 65 are axially aligned so as to fit or be received within seat means such as detent seats 66 positioned at measured points around the bottom edge of the circumference of the housing 34. In the preferred embodiment, there are three detent mechanisms 64 located around the top circumference of guide bushing 12 that fit into selected ones of eight evenly spaced detent seats disposed in housing 34. Alternatively, the detent bore/mechanisms 65/64 and detent seats 66 can be placed on the housing 34 and guide bushing 12, respectively. Also, there can be one detent mechanism 64 and a plurality of detent seats 66, or one detent seat 66 and a plurality of detent mechanisms 64, or any combination thereof.

The detent mechanisms 64 are of conventional design. As shown in detail in FIG. 2B, they may comprise ball bearings 64*a* biased by springs 64*b* against a rim or edge 64*c* whose circumference is smaller than that of the ball bearing. Thus, part of the ball bearing protrudes from the member, yet is insertable back into the member if the biasing spring force is overcome. The ball bearing of each detent mechanism 64 fits into a detent seat 66 to allow for indexing by discrete rotation of the guide bushing relative to the housing to thereby achieve rotation of the guide bushing 12 relative to housing 34 without having to release or disengage anything. When the detent mechanisms 64 are seated in detent seats 66, guide bushing 12 is sufficiently non-rotatable for normal operation relative to housing 34.

To achieve length adjustments of the punch, guide bushing 12 is rotationally indexed relative to housing 34 in discrete amounts determined by detent mechanisms 64 fitting into detent seats 66. This discrete rotation turns the threaded engagement between the punch 10 and punch driver 22. Since the pitch angle of this thread frictionally securing punch 10 to punch driver 22 is known, the amount of length adjustment achieved by the discrete rotations is also known. Thus, simple, quick and accurate length adjustments can be accomplished when punch 10 becomes worn merely through rotation of the guide bushing relative to the housing. To make the setting of the total length of the punch 10 and the punch driver 22 easier, it is also possible to apply visible markers (not shown) at the exterior circumference of the slip-on bushing 28.

Figure 2:
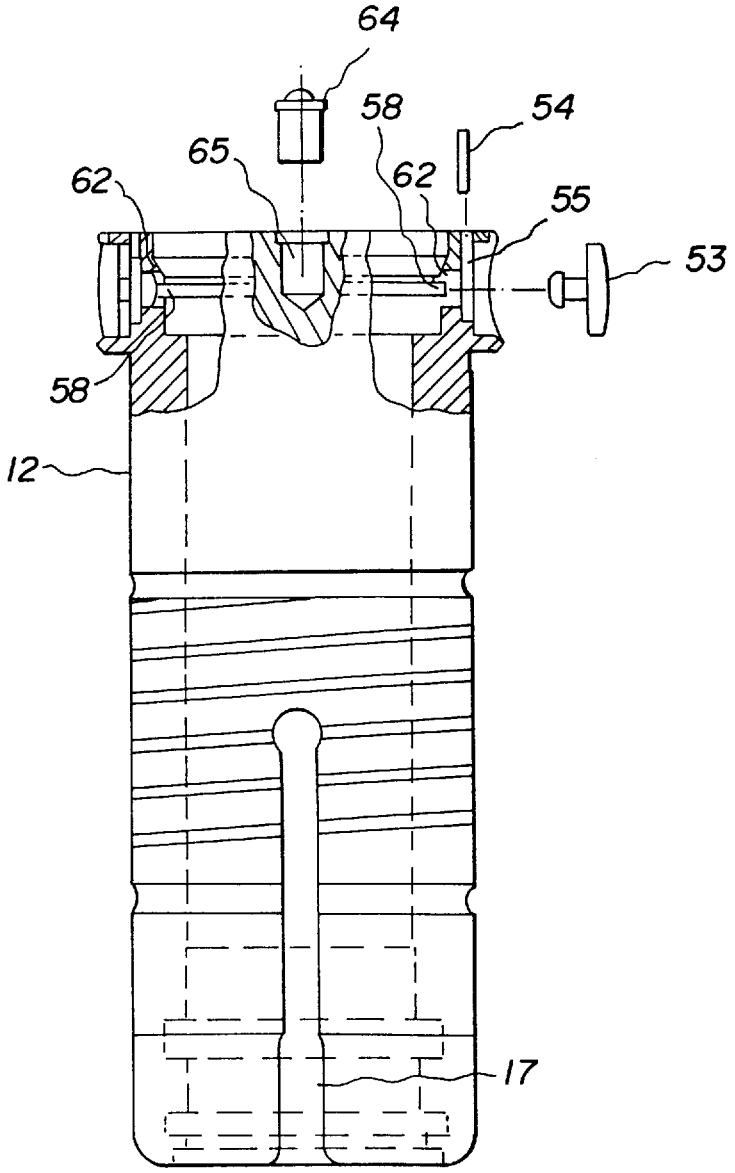
FIG. 2 is a side elevation view of the lower portion of the punch unit shown in FIG. 1 with portions shown in cross-section.
Figures 2A, 2B, 2C:
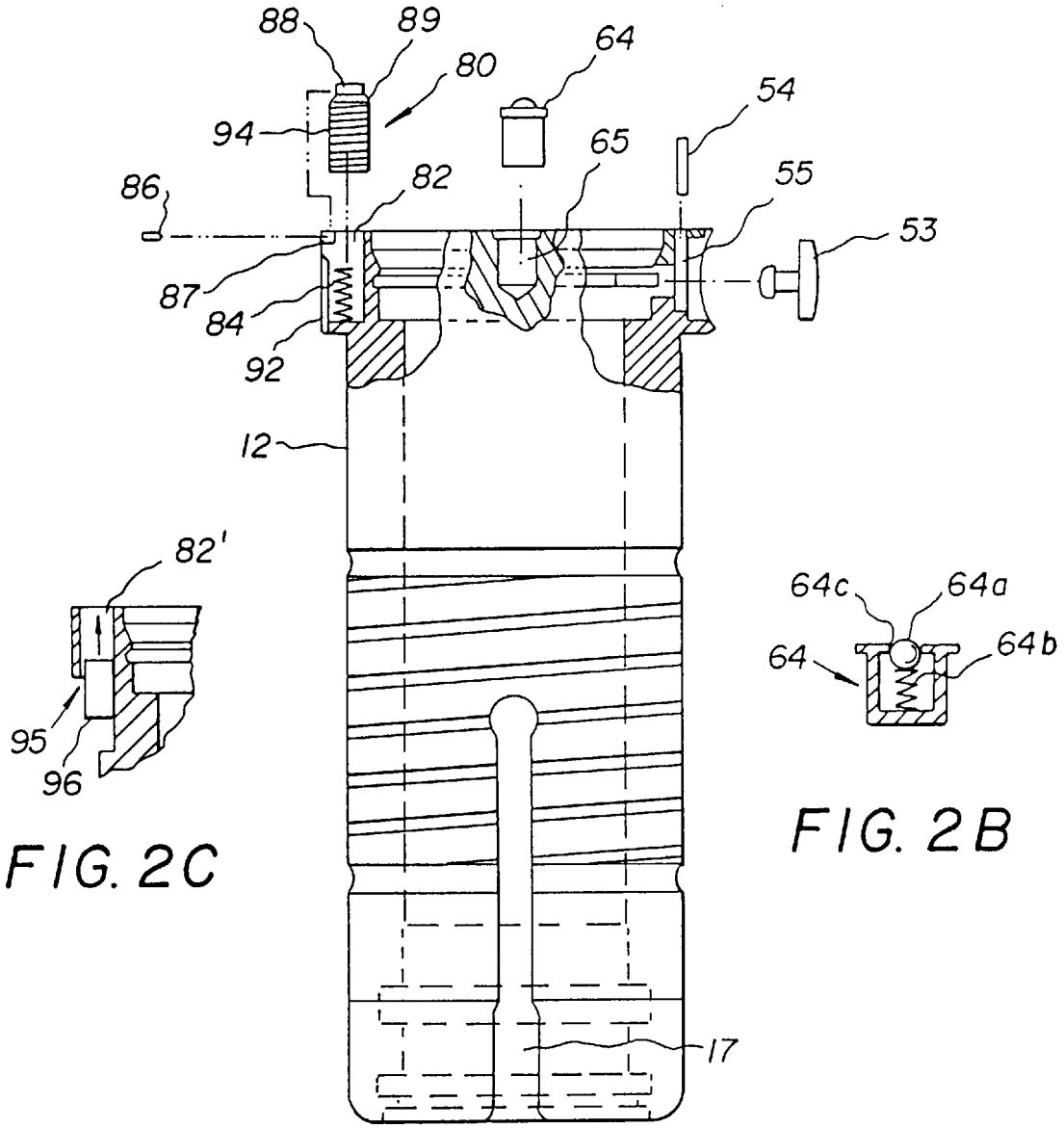
FIG. 2A is similar to FIG. 2, but additionally showing a modification.
FIG. 2B is an enlarged, cross-sectional detailed view of the detent 64 of FIG. 2A.
FIG. 2C illustrates a modification of the embodiment shown in FIG. 2A.

FIG. 2A depicts a modification of FIG. 2 for use in applications where strong turning forces are applied to one main part or the other during normal operation. This modification shows a locking means in which the snap-in projection is in the form of a post 80 which is inserted axially into an axial bore 82 which is positioned to match with one of the detent seats 66 located at measured points around the bottom edge of the circumference of housing 34 when the other, ball type projections 64 are similarly seated in other detent seats 66. Spring 84 is located in the bottom of axial bore 82 to upwardly bias post 80 into detent seat 66. Pin 86 is radially disposed in pin bore 87 which is located at the top circumferential edge of guide bushing 12 so that pin 86 meets a shoulder 89 adjacent post top 88 of post 80 to limit outward movement of post 80 from axial bore 82. Recess 92 opens into axial bore 82 to expose the side of post 80. Post 80 additionally has ridges, knurling or the like 94 to provide frictional engagement between itself and a user's thumb which comes in contact with the post to downwardly bias post 80 against spring 84 to disengage post top 88 from detent seat 66, to thereby enable a user to manually rotate guide bushing 12 relative to housing 34.

Referring to FIGS. 2–4 the connecting means of the guide bushing 12 comprises two push buttons 53 oppositely positioned across from one another radially about the top circumference of guide bushing 12 and C-ring 56 together with its groove 57. Pins 54 are positioned vertically in bores perpendicularly oriented with respect to the radial bores 55 which receive push buttons 53 so that the radial movement of push buttons 53 is limited and the push buttons 53 do not fall radially outward.

When guide bushing 12 and housing 34 are engaged, push buttons 53 are outwardly biased by main securing C-ring 56. This main securing C-ring 56 (shown in FIGS. 3 and 4) is mounted around the bottom exterior circumference of housing 34 in a groove 57 cut into the housing and fixed by pin 60 to prevent rotation of the main securing C-ring 56. The main securing C-ring 56 has two radial protrusions 61 which extend slightly beyond the groove in the housing 34 and beyond the radius of the housing 34 to engage with an interior groove 58 located at the top interior circumference of guide bushing 12.

Guide bushing 12 and housing 34 are separable by rotating guide bushing 12 relative to housing 34 so that push buttons 53 are matched with radial protrusions 61, and depressing push buttons 53 inward against the radial protrusions 61. Separation occurs as a result of protrusions 61 no longer being extended into the interior groove 58 of guide bushing 12.

FIG. 1 shows guide bushing 12 and housing 34 connected. When connecting these parts housing 34 is inserted into the top or back end of guide bushing 12 and radial protrusions 61 meet a rim 62 angled down and radially inward. This inwardly angled rim 62 is located above the interior groove 58 of guide bushing 12 so that the more housing 34 is inserted into guide bushing 12, the more the radial protrusions 61 are forced radially inward against outward biasing until the protrusions 61 of C-ring 56 are pushed beyond the rim and the protrusions 61 snap back into the interior groove 58 of guide bushing 12 due to the biasing of C-ring 56.

FIG. 4 illustrates the outward biasing of radial protrusions 61 caused by the springing action of securing C-ring 56. Detent seats 66 are seen in measured places around housing 34.

Figure 5:
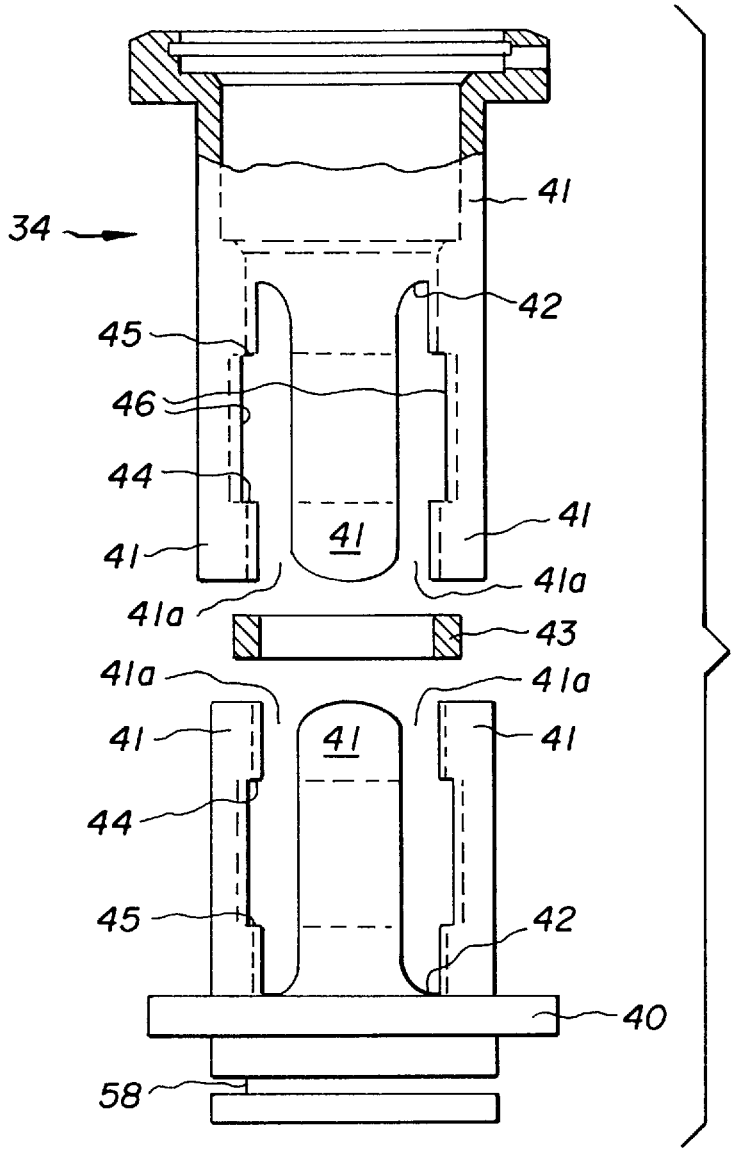
FIG. 5 is an exploded side elevational view of the housing with the top and bottom housing parts shown in axial alignment but, for purposes of illustration, not aligned rotationally, and with the cooperating ring shown in cross-section.

Referring especially to FIGS. 3 and 5, housing 34 comprises housing top part 39 which slidably engages housing bottom part 40. The slidable engagement as seen in FIG. 3, comprises alternating engaging fingers 41 disposed upon both the housing top part 39 and the housing bottom part 40 which engage grooves 41*a* in the other part. The engaging fingers 41 and grooves 41*a* cooperate with each other so that compression spring 32 cannot be compressed beyond the point when the distal ends of the engaging fingers 41 abut the bottoms 42 of the grooves 41*a*. Movement of housing top part 39 relative to housing bottom part 40 is restricted in the direction away from each other by engagement of annular ring 43 with front relief surfaces 44 in the top and bottom parts and movement towards each other is restricted by engagement of ring 43 with back relief surfaces 45 in the top and bottom parts. Both front and back relief surfaces 44, 45 are formed in the radial direction due to the cutting of a relief 46 in each finger 41. Front relief surfaces 44 are disposed towards the distal ends of fingers 41 located on both the housing top and bottom parts 39, 40. Back relief surfaces 45 are therefore located more towards the proximal ends of both the housing top and bottom parts 39, 40 than are from relief surfaces 44. When properly assembled and in the rest position before punching, as shown in FIG. 3, annular ring 43 prevents the two housing parts from moving axially by engagement with the front relief surfaces 44.

Annular ring 43 can be a solid metal ring which is inserted between the housing parts by orienting annular ring 43 perpendicularly to the horizontal resting position which is shown in the figures and placing it into opposite grooves 41*a* of housing bottom part 40. Annular ring 43 is then rotated in the direction which is circumferential to housing part 40 so as to fit between opposite reliefs 46 of opposite engaging fingers 41. Compression spring 32 can then be placed over housing bottom part 40, so housing top part 39 can be oriented to engage grooves 41a of housing bottom part 40 as described above. With a sufficient force compressing spring 32 so that the reliefs on both housing parts 39 and 40 are aligned in the horizontal plane, annular ring 43 can be rotated from its vertical insertion position to its horizontal resting position from the opening which receives punch driver 22.

Alternatively annular ring 43 can be a split ring or a C-ring and inserted between top and bottom housing parts 39, 40 by inserting the ring area of the reliefs and then allowing it to resiliently spring outwardly to the operative position as shown.

Figure 6:
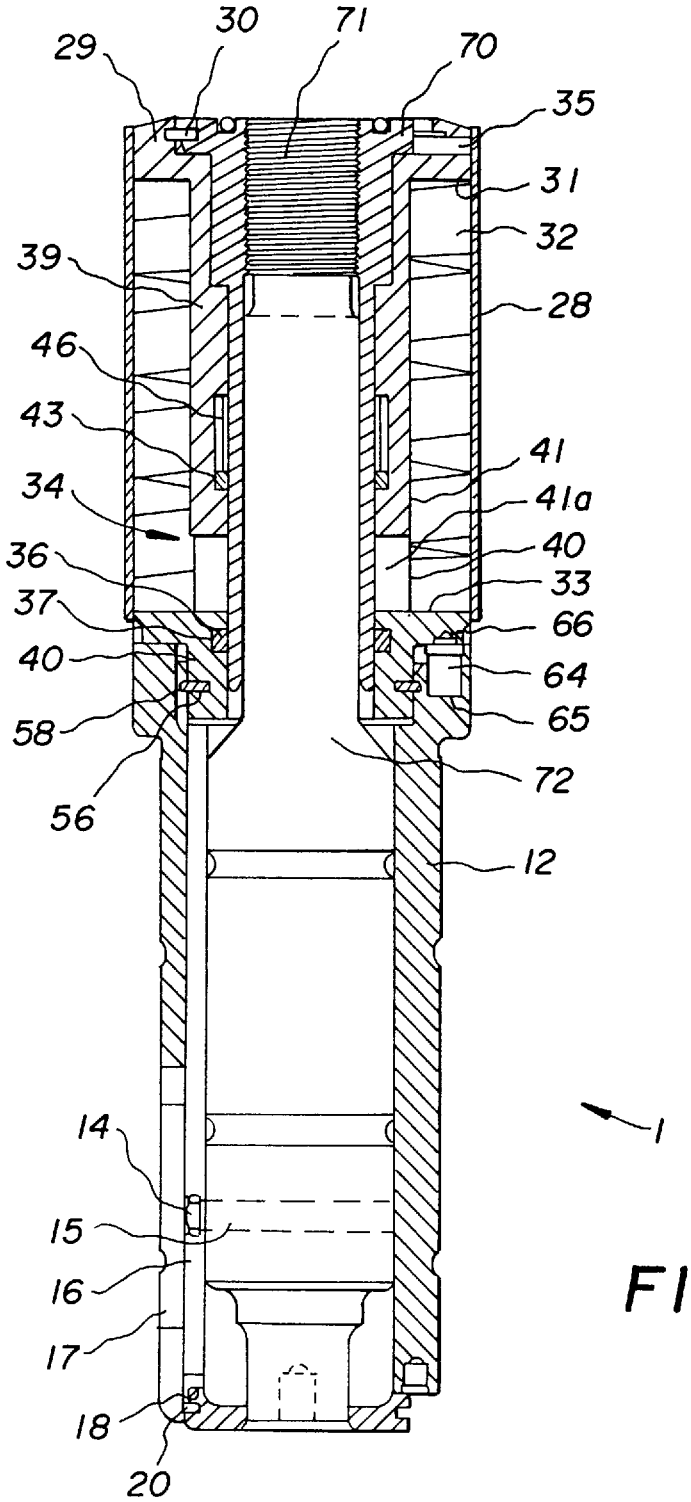
FIG. 6 is a central cross-sectional view similar to FIG. 1, but showing an alternative embodiment of the punch unit of the invention wherein the punch and punch driver are constructed as a single piece.

FIG. 6 depicts an alternative embodiment of punch unit 1 wherein the punch and punch driver are made in a single piece construction, rather than a two piece construction as shown in FIG. 1. In order to allow for length alterations to be made as in the first embodiment, punch head 70 has internal threads which thread with the external threaded portion 71 of the one piece punch and punch stem 72. In all other respects, this embodiment is identical to the embodiment of FIGS. 1–5.

Although in a preferred embodiment the projections on the housing 34 or guide bushing 12 are spring biased into their respective seats in the other member, it is also possible, to employ non-resilient projections which are pushed into their respective recesses through a hole in either the guide bushing or housing by a force other than a spring bias, for example a manual force, and locked therein by any suitable means. Thus, the example, as shown schematically in FIG. 2C, axial bore 82' could possibly extend through the entire guide bushing 12 so that a non-resilient projection, such as a pin, i.e., a pin such as 80 or a pin without the ridges 96 can be inserted from the bottom 95 of the axial bore 82' and secured therein by suitable means, to be seated in detents 66, to thereby prevent relative rotation of guide bushing 12 and housing 34.

Although the invention has been described in considerable detail with respect to preferred embodiments thereof, variations and modifications will be apparent to those skilled in the art without departing from the spirit and scope of the invention set forth in the claims.

We claim:

1. A punch unit comprising:

a housing;

a punch driver axially received in said housing;

a guide bushing, the guide bushing being connected to said housing so as to be rotational relative thereto;

connecting means for connecting the guide bushing to the housing, said connecting means comprising radial protrusions secured to the housing and disposed within a circumferential groove on the guide bushing so as to restrict disengagement of the guide bushing and the housing;

a punch mounted in the guide bushing against rotational movement relative thereto, the punch being adjacent to the punch driver;

spring means biasing the punch driver axially away from the guide bushing; and indexing means for rotationally positioning the guide bushing relative to the housing, said indexing means comprising spring biased means on one of the guide bushing or housing engaging a recess in the other of the guide bushing or housing, such that, (1) during normal operation of the punch unit, in the engaged position of the spring biased means, the housing and the guide bushing remain fixed rotationally with respect to each other and (2) for adjustment purposes, disengagement of the spring biased means allows for rotation of the guide bushing and housing relative to each other to adjust the combined length of the punch and punch driver.

2. A punch unit as claimed in claim 1 wherein the punch is threadedly engaged with the punch driver and the punch driver is rotationally fixed with respect to the housing, whereby rotating the housing relative to the guide bushing turns the punch driver relative to the punch to adjust the combined length of the punch and punch driver.

3. A punch unit as claimed in claim 1 wherein the punch and punch driver are integral and threadedly engaged to the housing, whereby rotating the housing relative to the guide bushing turns the housing relative to the punch and punch driver to adjust the position of the punch and punch driver relative to the guide bushing.

4. A punch unit as claimed in claim 1 wherein the indexing means comprises snap-in projection means on one of the guide bushing and the housing and seat means on the other of the guide bushing and the housing, such that in said normal operation the projection means is snapped into the seat means, and for adjustment purposes, upon disengagement of the projection means and the seat means, the housing and the guide bushing are rotatable relative to each other for movement to a different rotational position at which different projection means and seat means engage each other.

5. A punch unit as claimed in claim 4 wherein each snap-in projection means comprises a detent mechanism resiliently received in a bore and biased to an outer projected position and resiliently movable into the bore when the housing and guide bushing are caused to rotate relative to each other.

6. A punch unit as claimed in claim 5 wherein said detent mechanism comprises a ball bearing outwardly biased by a spring.

7. A punch unit as claimed in claim 5 wherein said detent mechanism comprises a spring biased locking post positively engaging said seat means.

8. A punch unit as claimed in claim 4 wherein at least one of said snap-in projection means comprises a locking post biased into one of said seat means and removable therefrom only by positive axial movement thereof out of said seat means.

9. A punch unit as claimed in claim 8 wherein said locking post has ridges disposed on a side thereof, said ridges being exposed to enable a user to frictionally engage the locking post to positively move it axially out of its seat to allow for manual relative rotation of said guide bushing and said housing.

10. A punch unit as claimed in claim 1 wherein said connecting means further comprises punch buttons which disengage said radial protrusions from said circumferential groove so as to effectuate separation of said guide bushing from the housing.

11. A punch unit as in claim 1 wherein said punch is operably attached to said punch driver by a threaded engagement.

12. A punch unit as claimed in claim 1 wherein said guide bushing receives said punch and said punch driver for guiding axial displacement of said punch, said housing comprising a front stop surface and a rear stop surface, said spring means comprising a compression spring maintained under pre-load between said front and rear stop surfaces.

13. A punch unit as in claim 1 wherein said indexing means allows for connecting said guide bushing and said housing in a plurality of rotational orientations with the guide bushing and said housing aligned axially.

14. A punch unit as in claim 1 wherein said housing comprises two axially relatively moving parts that move towards each other in response to a punch stroke and compression of said spring means, and a cooperating ring for restricting movement of said moving parts away from each other upon release of the spring.

15. A punch unit comprising:

a housing;

a punch driver axially received in said housing;

a guide bushing connected to said housing so as to be rotational relative thereto;

a punch mounted in the guide bushing against rotational movement relative thereto, the punch being operably attached to the punch driver;

spring means biasing the punch driver axially away from the guide bushing; and indexing means for rotationally positioning the guide bushing relative to the housing, said indexing means comprising opposed facing radial surfaces on the housing and guide bushing, at least one projection in one of said facing radial surfaces selectively engaging or disengaging at least one recess in the other of said facing radial surfaces, such that (1) during normal operation of the punch unit the projection engages said recess to prevent rotation of the housing and guide bushing relative to each other and (2) with the projection disengaged from the recess, the housing and guide bushing are rotatable relative to each other to adjust the combined length of the punch and the punch driver, said projection being axially movable with respect to the housing or the guide bushing in which it is located such that it is removable from said recess by positive axial movement of said projection out of said recess.

16. A punch unit as in claim 15 comprising a plurality of projections and recesses, the projections being spring biased into their respective recesses.

17. A punch unit as claimed in claim 16 wherein at least one of the projections comprises a ball bearing in one of the housing or guide bushing, spring biased into one of said recesses in the other of said housing or guide bushing.

18. A punch unit as in claim 15 wherein said projection is non-resiliently fitted within an axial bore located in either one of said housing or said guide bushing to engage one of said recesses.

19. A punch unit as claimed in claim 15 wherein said projection is spring biased into said recess.

20. A punch unit comprising:

a housing including a pair of axially relatively moving parts;

a punch driver axially received in said housing;

a guide bushing, the guide bushing being connected to said housing so as to be rotational relative thereto;

a punch mounted in the guide bushing against rotational movement relative thereto, the punch being operably attached to the punch driver;

spring means for biasing the punch driver axially away from the guide bushing; and a cooperating ring that cooperates with said pair of relatively moving parts, wherein said moving parts move towards each other in response to a punch stroke and compression of said spring means, and said cooperating ring restricts movement of said moving parts toward each other upon compression of the spring, and away from each other upon release of the spring.

21. A punch unit as in claim 20 wherein said axially moving parts include a pair of opposed housing parts, each comprising fingers and grooves, the fingers of one part engaged in the grooves of the other part, the parts being spring biased away from each other by the spring means.

22. A punch unit as in claim 21, each finger having a relief therein, and said cooperating ring comprising an annular ring engaging all of the reliefs of all of said fingers to limit movement of the two parts away from each other and defining the maximum expansion position of the spring means.

23. A punch unit as in claim 20 wherein said cooperating ring further comprises a pair of axial faces, and each of said pair of moving parts further comprises a front relief surface, wherein one of said front relief surfaces interfaces with one of said pair of axial faces, and the other of said front relief surfaces interfaces with the other of said pair of axial faces when said punch is in an uncompressed position.

24. A punch unit as in claim 23 wherein said punch unit has a longitudinal axis and said front relief surfaces and said axial faces are perpendicular to said longitudinal axis.

25. A punch unit as in claim 20 wherein said cooperating ring further comprises a pair of axial faces, and each of said pair of moving parts further comprises a back relief surface, wherein one of said back relief surfaces interfaces with one of said pair of axial faces, and the other of said back relief surfaces interfaces with the other of said pair of axial faces when said punch is in a compressed position.

26. A punch unit as in claim 25 wherein said punch unit has a longitudinal axis and said back relief surfaces and said axial faces are perpendicular to said longitudinal axis.

* * * * *